US006250774B1

(12) United States Patent
Begemann et al.

(10) Patent No.: US 6,250,774 B1
(45) **Date of Patent: *Jun. 26, 2001**

(54) LUMINAIRE

(75) Inventors: Simon H. A. Begemann; Albertus J. H. M. Kock, both of Eindhoven (NL)

(73) Assignee: U.S. Philips Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/012,319

(22) Filed: Jan. 23, 1998

(30) Foreign Application Priority Data

Jan. 23, 1997 (EP) ..... 97200149

(51) Int. Cl.[7] ..... F21V 7/09

(52) U.S. Cl. ..... 362/231; 362/240; 362/245; 362/800

(58) Field of Search ..... 362/230, 231, 362/236, 237, 240, 241, 243, 244, 245, 251, 800

(56) References Cited

U.S. PATENT DOCUMENTS

| | | | | |
|---|---|---|---|---|
| 4,698,730 | * | 10/1987 | Sakai et al. | 362/800 |
| 5,105,179 | * | 4/1992 | Smith | 340/468 |
| 5,404,282 | | 4/1995 | Klinke et al. | 362/249 |
| 5,580,156 | * | 12/1996 | Suzuki et al. | 362/240 |
| 5,893,633 | * | 4/1999 | Uchio et al. | 362/244 |

FOREIGN PATENT DOCUMENTS

| | | |
|---|---|---|
| 3022974A1 | 1/1982 | (DE) . |
| 3806217A1 | 9/1989 | (DE) . |
| 4431750 | 3/1996 | (DE) . |
| 0748979A1 | 12/1996 | (EP) . |
| WO9523313 | 8/1995 | (WO) . |

* cited by examiner

*Primary Examiner*—Y. Quach
(74) *Attorney, Agent, or Firm*—Dicran Halajian

(57) ABSTRACT

A luminaire (1) comprises a housing (10) with a light emission window (11), and at least one lighting module (2) accommodated in the housing for illuminating an object. The lighting module comprises a set of lighting units (20) which each comprise at least an LED chip (30) and an optical system (40) coupled thereto. The lighting units illuminate respective portions of an object. The LED chips supply a luminous flux of at least 5 lm each.

15 Claims, 8 Drawing Sheets

LUMINAIRE

BACKGROUND OF THE INVENTION

The invention relates to a luminaire comprising a housing with a light emission window, and at least one lighting module for illuminating an object accommodated in the housing and comprising a light source and optical means.

Such luminaires are generally known and are used, for example, for street lighting, for lighting a portion of a street, or in spotlighting, for example for lighting objects in shop windows.

A luminaire for street lighting of the kind described in the opening paragraph and fitted with two lighting modules is known from DE 44 31 750 A1. The first lighting module is designed for illuminating a surface portion of the road which extends to comparatively far away from the luminaire. The second lighting module is designed for illuminating a surface portion close to the luminaire. The light sources of the luminaire can be controlled independently of one another so as to illuminate a road section optimally both in wet and in dry weather. The lighting modules in the known luminaire each have a tubular discharge lamp as the light source and a reflector as the optical means. A disadvantage of such a luminaire is that the light from the light sources is difficult to concentrate into a beam. More than 50% is often incident outside the object to be illuminated in practice.

SUMMARY OF THE INVENTION

It is an object of the invention to provide a luminaire in which the light generated by the light source is utilized more efficiently.

According to the invention, the lighting module comprises a set, for example a few dozen, of lighting units which each comprise at least one LED chip and an optical system cooperating therewith, the LED chips and optical systems forming the light source and the optical means, respectively, while the lighting units illuminate portions of the object during operation, and the LED chips each supply a luminous flux of at least 5 lm during operation.

An LED chip comprises an active layer of a semiconductor material, for example AlInGaP or InGaN, which emits light upon the passage of a current. Integrated units of an LED chip and a primary optical system are generally known under the name of LEDs (Light Emitting Diodes), also referred to as LED lamps. The surface area of the active layer of an LED chip is comparatively small, for example of the order of a few tenths of a $mm^2$ up to a few $mm^2$. An LED chip thus forms a good approximation of a point source, so that the light generated thereby can be easily and accurately concentrated into a beam. Since the LED chips jointly illuminate the object, each individual beam only hitting a portion of the object, the beams may be narrow, so that they can be aimed with high accuracy within the boundaries of the object and only little light is incident outside the object. The use of LED chips which each supply a luminous flux of at least 5 lm during operation results in a luminaire according to the invention which, in spite of a comparatively limited number of lighting units, yet offers wide application possibilities, for example for street lighting, spotlighting, or floodlighting. The light distribution may be adjusted in a flexible manner through a control of the luminous fluxes of lighting modules or of separate lighting units of a lighting module.

If so desired, the portions of the object to be illuminated may overlap one another so as to achieve a more homogeneous lighting result, for example illuminance or luminance. Overlaps of the portions to be illuminated may also be desirable for achieving an even light distribution. A measure for the overlaps is the overlap factor (O) defined as $O=(\Sigma\Omega_e-\Omega_a)/\Omega_a$ where $\Sigma\Omega_a$ is the sum of the beam angles of the lighting units, and $\Omega_a$ is the optical solid angle covered by the object to be illuminated with respect to the luminaire. The beam angle of a lighting unit is defined here as the solid angle of that portion of the beam generated by the lighting unit within which 65% of the luminous flux of the lighting unit is contained and within which the luminous intensity is greater than or equal to that outside it. A lighting unit may illuminate portions of the object remote from one another, for example as a result of components which split up the beam of the lighting unit. In that case the beam angle is the sum of the solid angles of those portions of the beam within which in total a 65 % fraction of the luminous flux of the lighting unit is contained and within which the luminous intensity is greater than or equal to that outside said portions. The overlap factor is preferably at most 10 in a fully illuminated object. The homogeneity of the lighting result increases only little when the overlap factor increases further. The ratio of the overlap factor (O) to the number of lighting units (N) is preferably below 0.2. At a higher ratio, comparatively strongly widening beams are necessary, so that the light generated by the luminaire can be aimed less efficiently within the boundaries of the envisaged object and the possibilities of varying the distribution of the illuminance are limited.

It is favourable when the LED chips generate light mainly in a wavelength range from approximately 520 nm to approximately 600 nm for applications where the luminous efficacy plays a major role and colour rendering is of lesser importance, for example for lighting of roads and garages. LED chips may be used for this purpose, for example comprising an active layer of AlInGaP with an emission maximum at 592 nm. A combination of red-, green-, and blue-emitting LED chips may be used in applications where on the contrary the colour rendering is important, such as lighting of domestic spaces, for example LED chips having an active layer of AlInGaP for emission in a wavelength range of 590–630 nm, and LED chips with an active layer of InGaN for emission in the wavelength ranges of 520–565 nm and 430–490 nm. The active layers of a red-, a green-, and a blue-emitting LED chip may then be provided on a common substrate, for example made of sapphire or silicon carbide, and these LED chips may have a common optical system. Alternatively, for example, lighting units may be used in which the LED chip emits UV radiation and the optical system of the lighting units comprises means for converting UV radiation into visible radiation. The means for converting UV radiation are formed, for example, by a luminescent layer provided on the LED chip.

An attractive embodiment of the luminaire according to the invention is characterized in that the set of lighting units comprises two or more varieties of lighting units for illuminating portions of the object with mutually differing spectra. The spectra of the lighting units may then be adapted to the optical properties, for example the reflectivity, of the individual portions of the object, so that an optimum visibility of these portions is realized. The different spectra in addition render it easy for an observer to orient himself.

The luminance often lies in the mesopic vision range in the case of outdoor lighting such as street lighting, safety lighting, and lighting of parking lots, i.e. between 0.001 and 3 $cd/m^2$. The eye sensitivity to light originating from the periphery of the field of vision under these circumstances is a maximum for a wavelength which is relatively short, approximately 510 nm, compared with a wavelength, approximately 555 nm, for which the eye sensitivity to light coming from the center of the field of vision is a maximum. A modification of the preceding embodiment which is particularly favorable for outdoor lighting is characterized in that the set of lighting units comprises a first variety of lighting units for illuminating central portions of the object with a spectrum having a maximum at a first wavelength and a second variety of lighting units for illuminating peripheral portions of the object with a spectrum having a maximum at a second wavelength which is smaller than the first wavelength. This modification is particularly suitable for road lighting, the first portion being, for example, a driving lane, and the second portion a lane lying alongside the former lane. A higher visibility of the surroundings, and a resulting shorter reaction time of drivers present in the driving lane are obtained thereby (given a certain energy consumption). The different spectra provide a clear demarcation of the driving lane, so that drivers can easily orient themselves. It is favorable when the first wavelength lies in a range from 550 to 610 nm and the second wavelength in a range from 500 to 530 nm. It is achieved thereby that the peripheral portions are illuminated with a spectrum to which the eye sensitivity is high. In addition, such a spectrum can be generated with a high luminous efficacy by means of LED chips having an active layer of the InGaN type.

A favourable embodiment of the luminaire according to the invention is characterized in that the set of lighting units comprises two or more types of lighting units for generating beams which widen more and less strongly. In this embodiment, the portions of the object to be illuminated may have approximately the same surface area and also approximately the same illuminance in that portions of the object situated close to the luminaire are illuminated with comparatively strongly widening beams and portions farther removed with comparatively less strongly widening beams. This renders it easier to subdivide the surface of the object to be illuminated into portions which are to be illuminated by specific lighting units.

The optical system of the lighting units may comprise, for example, reflecting, refracting, and/or diffracting optical elements. A practical embodiment of the luminaire according to the invention is characterized in that the optical system of the lighting units comprises a primary and a secondary optical system. The primary optical system is provided with a primary reflector on which the LED chip is provided and with a, for example hemispherical, transparent envelope in which the LED chip is embedded, and said secondary optical system being provided with a secondary, for example conical reflector in whose comparatively narrow end portion the LED chip is positioned. It is favourable for the generation of comparatively narrow beams when the secondary reflector supports a lens at an end opposite the comparatively narrow end portion.

An attractive embodiment is characterized in that the optical system of the lighting unit comprises a transparent body with a first optical part which deflects the light generated by the LED chip through refraction and a second optical part which deflects the light generated by the LED chip through reflection.

A favourable modification of the above embodiment is characterized in that the transparent body has a wide end and opposite thereto a comparatively narrow end portion, in which end portion the LED chip is embedded, while the side of the LED chip remote from the wide end of the transparent body is provided on a primary reflector. The transparent body has a spherical portion which is centrally positioned relative to an axis, which is recessed into the wide end, and which forms the first optical part, while the body has a peripheral portion around the axis with a paraboloidal circumferential surface around the axis which forms the second optical part.

The lighting units may be provided with means for adjusting a predetermined beam direction. The light distribution of the luminaire may thus be readily adapted during manufacture to the conditions of use, for example, in the case of a street lighting luminaire the width of the road and the interspacings of the posts on which the luminaires are mounted.

A favourable embodiment is characterized in that components of the optical systems of different lighting units are mutually integrated. This simplifies the operation of assembling the luminaire. Depending on the application, the components may, for example, deflect, narrow, and/or split up the beams generated by the LED chips. In a practical modification of this embodiment, the integrated components of the optical systems are reliefs in a transparent plate in the light emission window. Preferably, the relief is formed by substantially mirror-symmetrical ridges. Such a relief is capable of forming two comparatively strongly deflected beams from the incident beam with little stray light.

In a favourable modification of the above embodiment, lighting units are arranged in rows which extend along a longitudinal axis, lighting units in one and the same row having optical axes which are directed substantially mutually parallel and transverse to the longitudinal axis, while optical axes of lighting units of different rows enclose an angle with one another each time around a further axis parallel to the longitudinal axis, and the integrated components form deflected beams, which are substantially symmetrically situated relative to a plane through the optical axis of the lighting unit and the further axis, from the beams formed by the lighting units. A comparatively large surface area to be illuminated can be covered at angles around the longitudinal axis thanks to the mutually differing orientations of the rows, and at angles transverse to the further axis and transverse to the optical axis thanks to the further optical means. Nevertheless, the luminaire is of a comparatively simple construction. The arrangement of the lighting units in rows, with the lighting units within one row having the same direction, renders possible a simple placement of the lighting units.

One or several luminaires according to the invention may form part of a lighting system according to the invention. An attractive embodiment of such a lighting system comprises one or several luminaires and a control system, the one or several luminaires together having at least two lighting modules which are controllable independently of one another by means of the control system. The control system may receive signals from sensors and other sources, so that the lighting situation, for example the light distribution, illuminance, or colour temperature, can be automatically adapted to the circumstances. The lighting system has the advantages here that the luminous flux of an LED chip is controllable over a wide range and that the LED chips generate light substantially immediately after switching-on. If the lighting system is used for street lighting, luminaires for street lighting may be connected to a common control system. To adapt the lighting conditions to the weather conditions, the control system may receive signals inter alia from a fog detector and from means which measure the reflection properties of the road surface. A system for interior lighting receives signals, for example, from a daylight sensor which measures the luminous flux of incident daylight and from a proximity detector which detects the presence of persons in the room to be illuminated.

DETAILED DESCRIPTION OF THE PREFERRED EMBODIMENTS

Figure 1A:
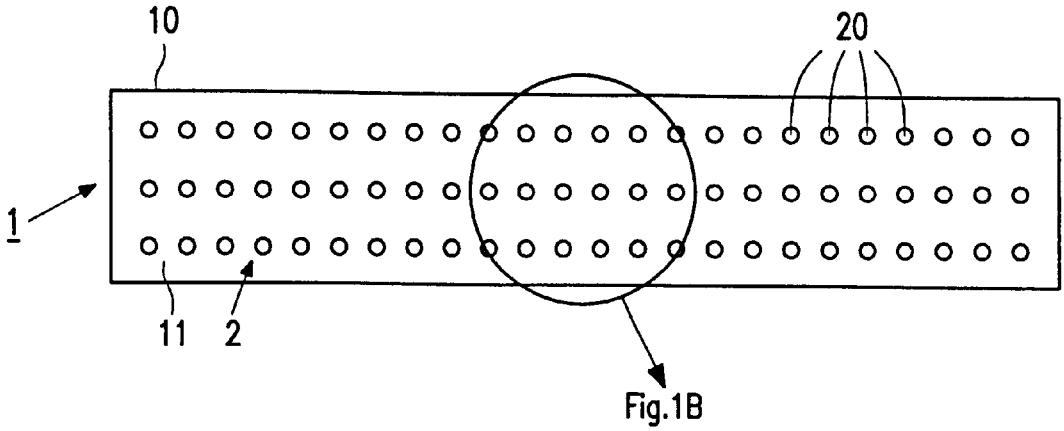
FIG. 1A diagrammatically shows a first embodiment of the luminaire according to the invention in elevation.
Figure 1B:
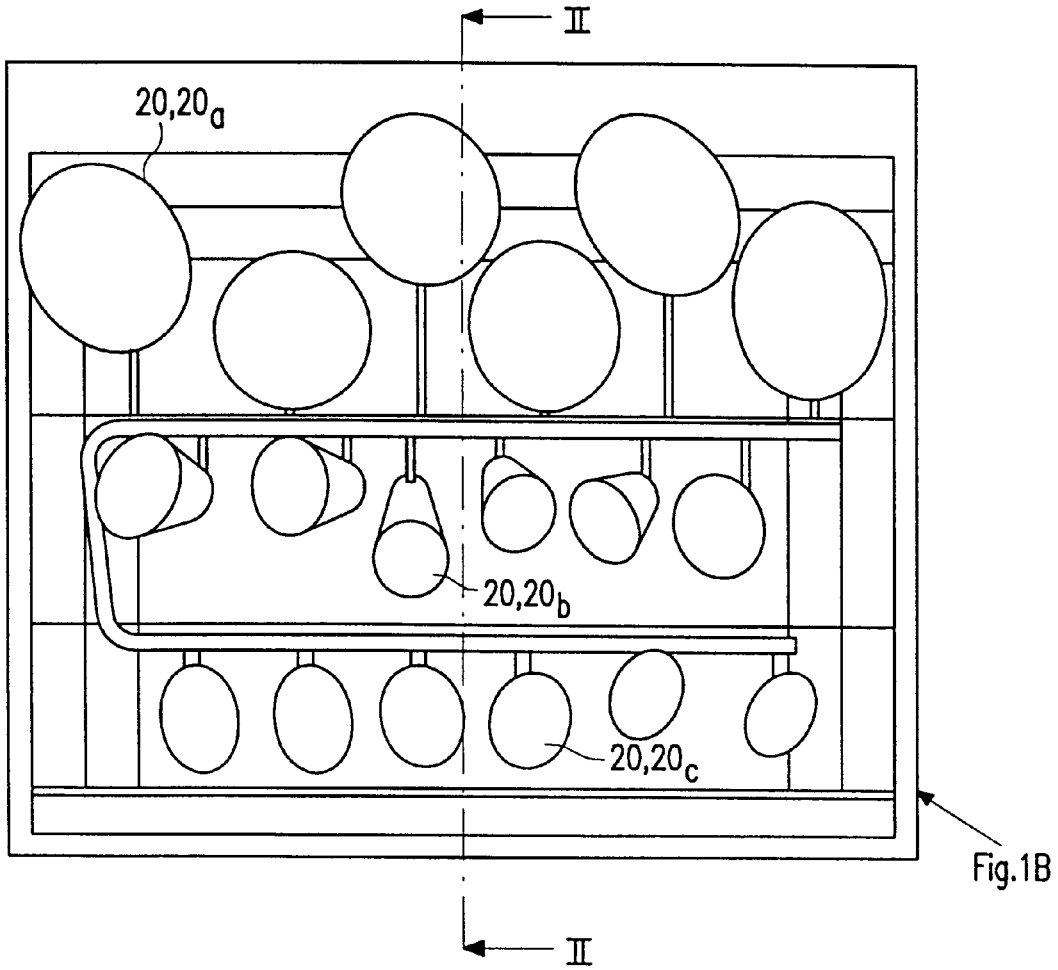
FIG. 1B shows a detail of this elevation.
Figure 2:
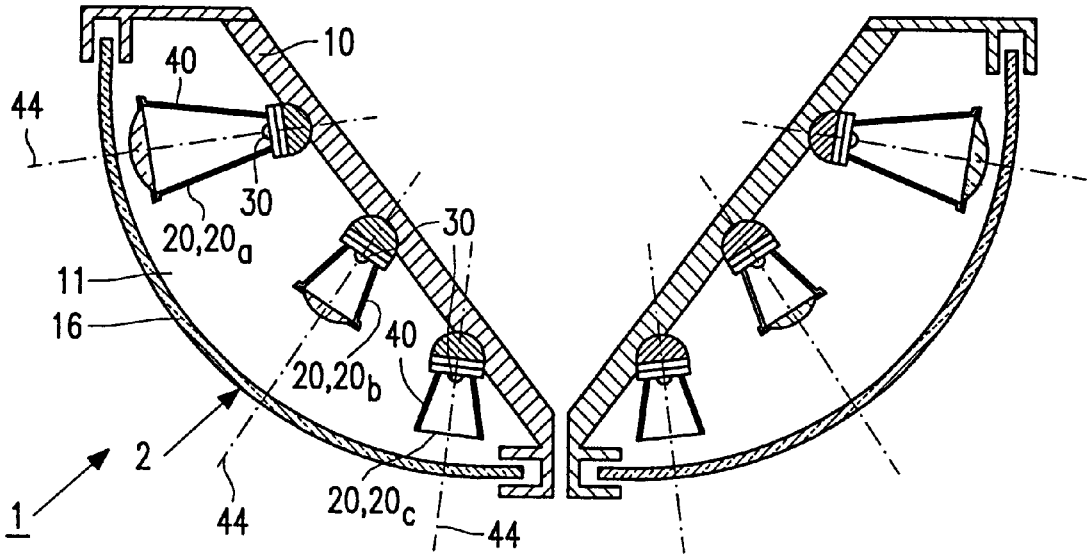
FIG. 2 is a cross-section of the luminaire taken on the line II—II in FIG. 1B.

A first embodiment of the luminaire 1 according to the invention is shown in FIGS. 1A, 1B and 2. The luminaire forms part of a row of luminaires which are placed with a mutual interspacing of 42 m each time. The luminaire 1 shown comprises a housing 10 with a light emission window 11 in which a transparent plate 16 is accommodated. The luminaire, which is mounted to a post (not shown) with a height of 7 m, is designed for street lighting. A lighting module for illuminating an object d (see FIG. 4) is accommodated in the housing. The object d to be illuminated here is a road section d1 with a width of 7 m and two strips d2, d3 on either side of the road section d1 having a width of 2.5 m each. The road section d1 and the two strips extend on either side of the post over a distance of 42 m. The lighting module comprises a light source and optical means.

The lighting module 2 comprises a set of, here 144 lighting units 20 which each comprise an LED chip 30 and an optical system 40 cooperating with said chip. The LED chips 30 and the optical systems 40 form the light source and the optical means, respectively. The lighting units 20 illuminate portions of the object. The LED chips 30 each supply a luminous flux of at least 5 lm, in this case 23 lm.

Figure 3:
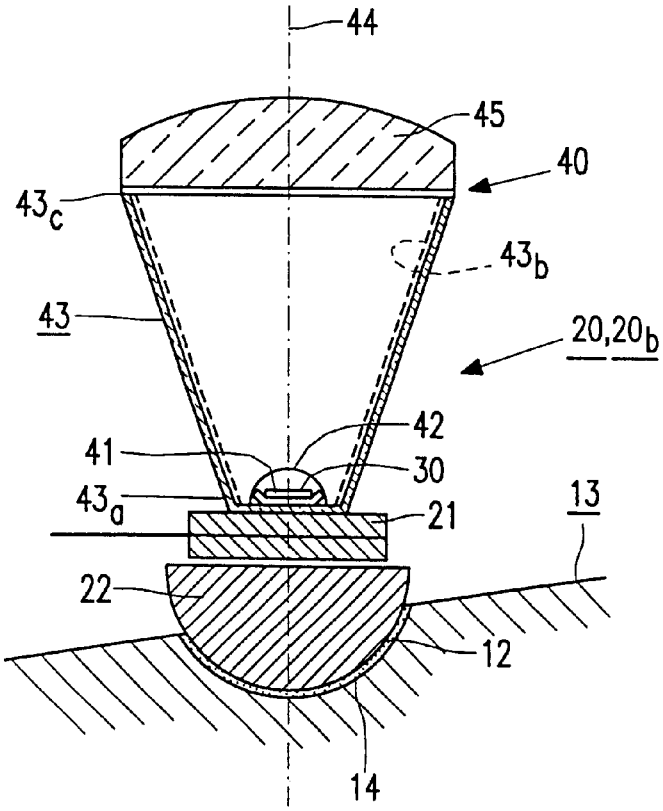
FIG. 3 is a longitudinal sectional view of a lighting unit of the first embodiment of the luminaire.

A lighting unit 20 is shown in more detail in FIG. 3. The LED chip 30 is provided on a primary reflector 41 of metal which is fastened on a synthetic resin support 21. The LED chip 30 is accommodated in a synthetic resin envelope 42 which together with the primary reflector 41 forms a primary optical system. LED chips 30 having an active layer of AlInGaP are used in the embodiment shown. The active layer has a surface of 0.5×0.5 mm perpendicular to an optical axis 44 and a thickness of 0.2 mm. The total light-emitting surface area is 0.65 $mm^2$.

The lighting units in the embodiment shown each have a hemispherical mounting member 22 which is accommodated in a mating recess 12 in an aluminum heat sink 13. The mounting member 22 and the recess 12 together form means for adjusting a predetermined beam direction. When the luminaire is being assembled, the lighting units 20 are provided in the desired directions on the heat sink 13, the mounting member 22 being fixed in the recess 12 by means of an adhesive agent 14.

The LED chip 30 with its primary optical system 41, 42 is arranged in a narrow end portion $\mathbf{43}_a$ of a secondary, conical reflector 43 which forms a secondary optical system. The secondary reflector 43, here made of acrylate, is coated with a reflecting material $\mathbf{43}_b$, for example aluminum, on an internal surface thereof. The secondary reflector 43 may support a lens 45 at an end $\mathbf{43}_c$ opposite the narrow end portion $\mathbf{43}_a$. The lens 45 and the secondary reflector 43 then together form a secondary optical system. The beam angle may be chosen through a choice of the dimensions of the reflector and of the lens, if present.

In the embodiment shown, the set of 144 lighting units 20 comprises three types of lighting units $\mathbf{20}_a$, $\mathbf{20}_b$, $\mathbf{20}_c$ for generating beams which widen more and less strongly. The lighting module here comprises 14 lighting units of a first type $\mathbf{20}_a$, in which the beam widens at a beam angle of 0.012 sr. The secondary reflector 43 in each module $\mathbf{20}_a$ supports a lens 45 at its end $\mathbf{43}_c$ opposite the narrow end portion $\mathbf{43}_a$. The lighting module in addition comprises 38 lighting units of a second type $\mathbf{20}_b$, also carrying a lens, of which the beam widens at a beam angle of 0.043 sr. Finally, the lighting module comprises 92 lighting units of a third type 203, without lenses, whose beam widens at a beam angle of 0.060 sr. The sum $\Sigma\Omega_c$ of the beam angles of the lighting units is 7.3 sr. The object to be illuminated occupies a spatial angle $\Omega_a$ of 2.6 sr relative to the luminaire. The overlap factor O accordingly is 1.82. The overlap factor (O) divided by the number of lighting units (N) is 0.012.

The object d is symmetrically illuminated with respect to a plane through the post and the y-axis. The illuminance realized by means of the luminaire decreases evenly with the absolute value of the x-coordinate with respect to the post. Two consecutive luminaires achieve an approximately homogeneous distribution of the illuminance between them.

Figure 4:
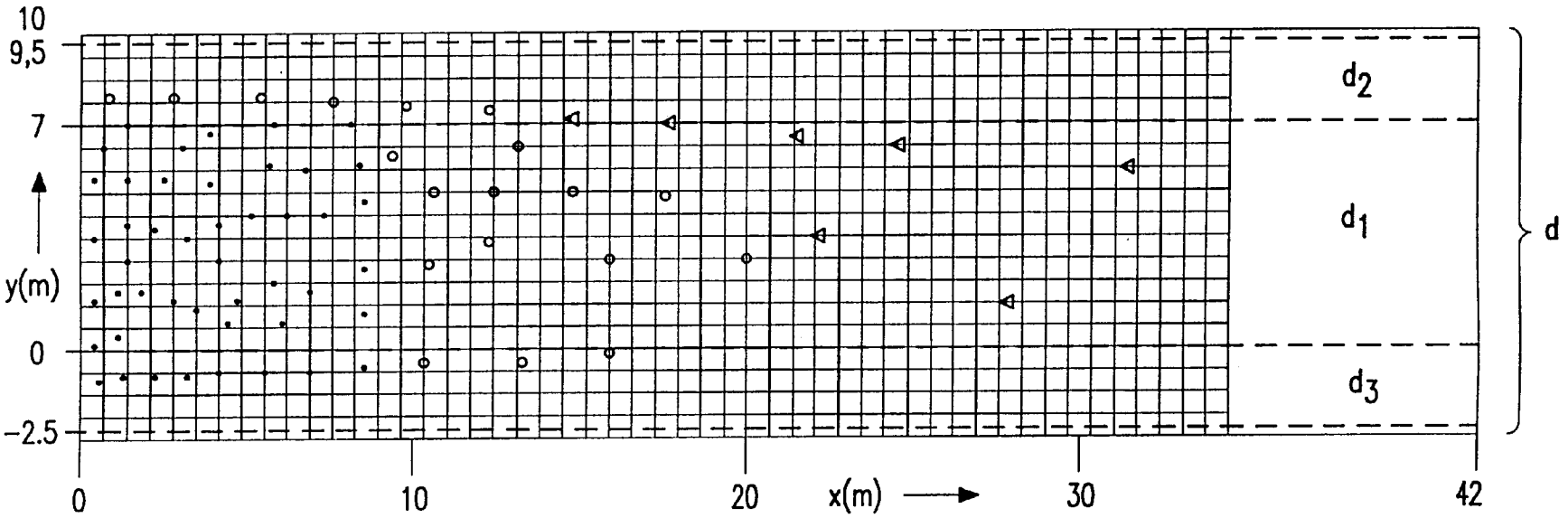
FIG. 4 shows the subdivision of the object into spatial portions.

FIG. 4 shows the subdivision of the road section into portions to be illuminated by the lighting units 20 by means of marks at one side of the post (position x=0, y=0). Portions to be illuminated by means of a lighting unit of the first (20*a*), the second (20*b*) and the third type (20*c*) have been marked with a triangle (Δ), a circle (o), and a dot (●), respectively. The location of the mark indicates the point of intersection between the optical axis 44 of the relevant lighting unit 20 and the portion of the object d to be illuminated thereby. It was found that the light generated by the light source in the luminaire 1 according to the invention is utilized efficiently. More than 95% is incident within the boundaries of the object to be illuminated, while still the object is illuminated in its entirety.

Figure 5:
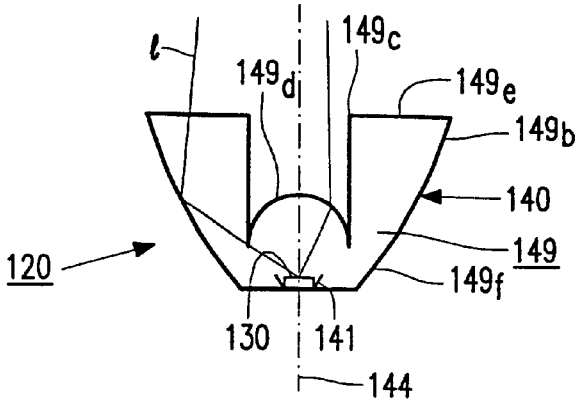
FIG. 5 is a longitudinal sectional view of a lighting unit in a modification

A lighting unit 120 of a modification of the first embodiment of a lighting module according to the invention is shown in FIG. 5. Components in this Figure corresponding to those in FIG. 3 have reference numerals which are 100 higher. The optical system 140 of the lighting units 120 in this embodiment comprises a transparent body 149 with an axis 144 and a paraboloidal circumferential outer surface $\mathbf{149}_b$ around the axis. The body 149 comprises, centrally relative to the axis, a recessed, spherical portion $\mathbf{149}_d$ at a wide end $149_c$ surrounded by a peripheral portion $149_c$. The LED chip 130 is embedded in a narrow end portion $149_f$ of the body. The LED chip 130 is provided with its side remote from the wide end $149_c$ on a primary reflector 141. The recessed portion $149_d$ forms a first optical part. The peripheral portion $149_c$ with the paraboloidal circumferential surface $149_b$ forms a second optical part. The first optical part $149_d$ operates as a positive lens which deflects the light generated by the LED chip 130 through refraction. Light 1 incident outside said portion $149_d$ is reflected at the circumferential outer surface $149_b$ and issues to the exterior at the peripheral portion $149_c$.

Figure 6:
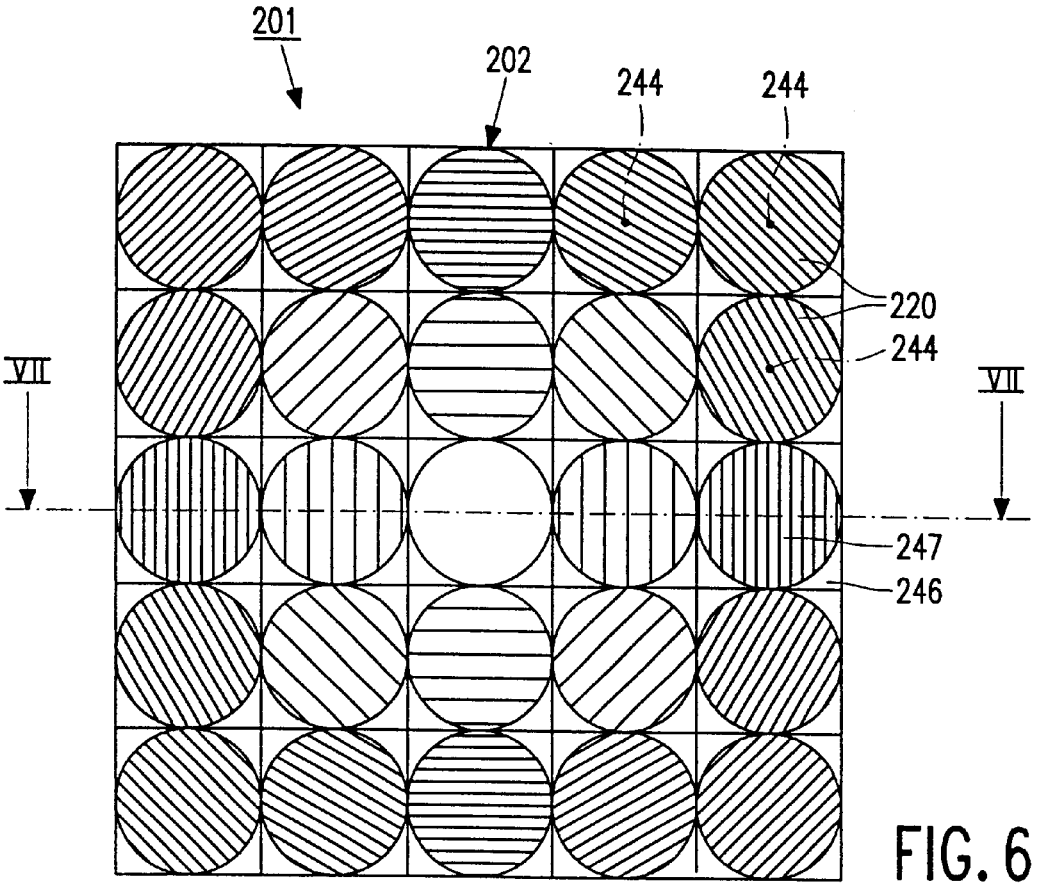
FIG. 6 shows a second embodiment.
Figure 7:
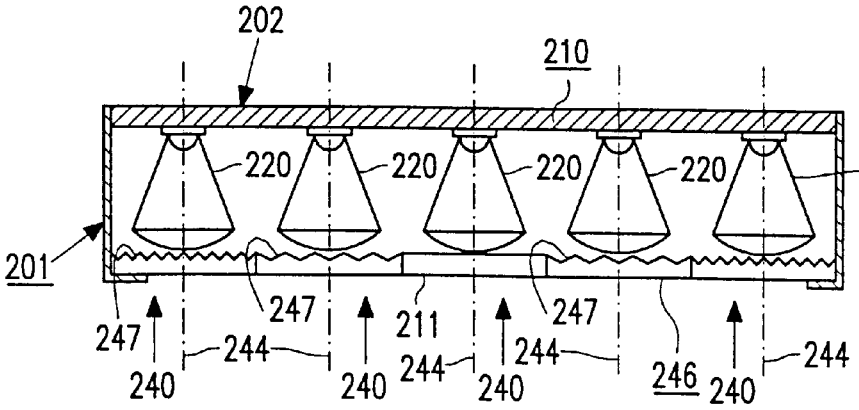
FIG. 7 is a cross-section taken on the line VII—VII in FIG. 6.
Figure 8:
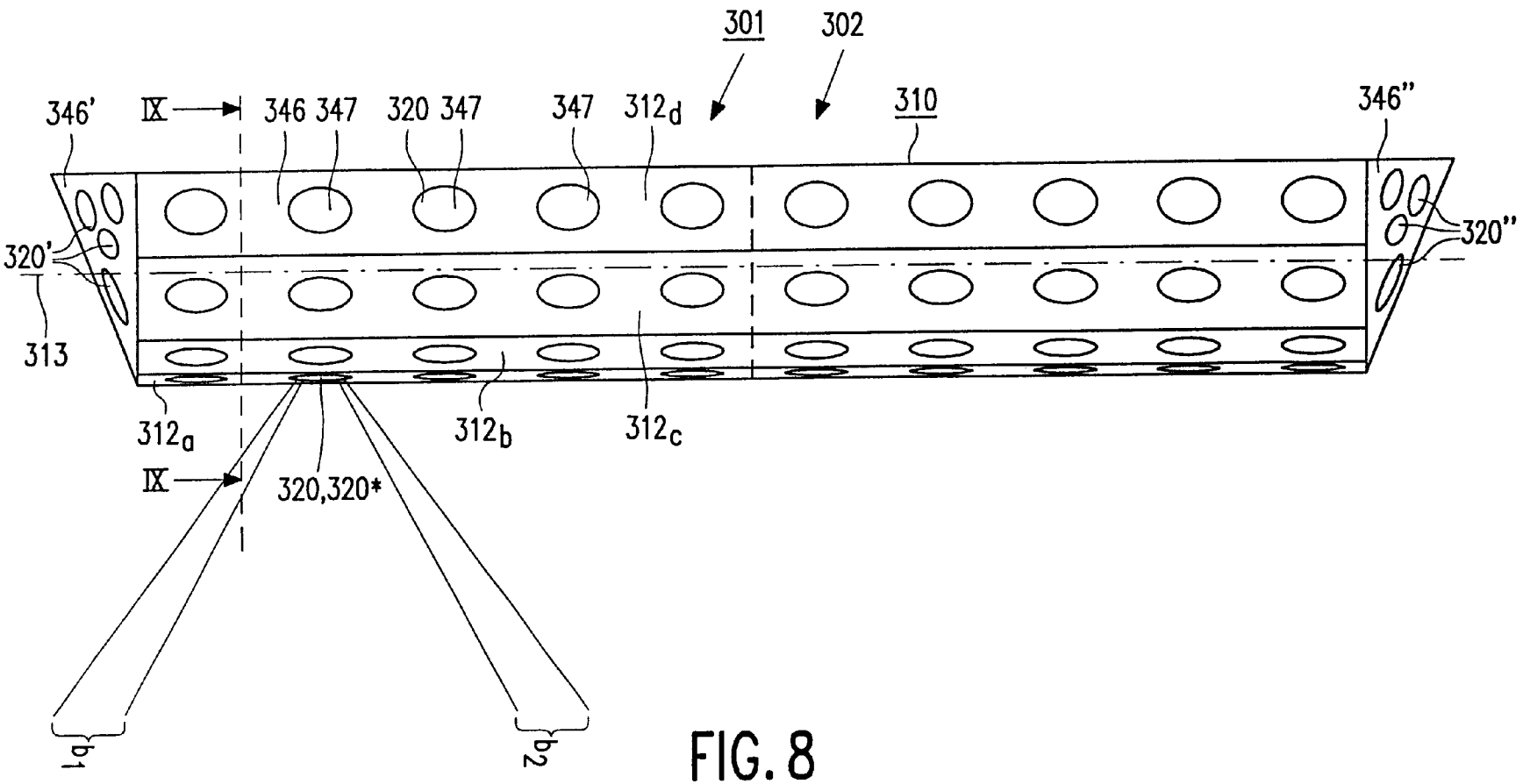
FIG. 8 shows a third embodiment.
Figure 9:
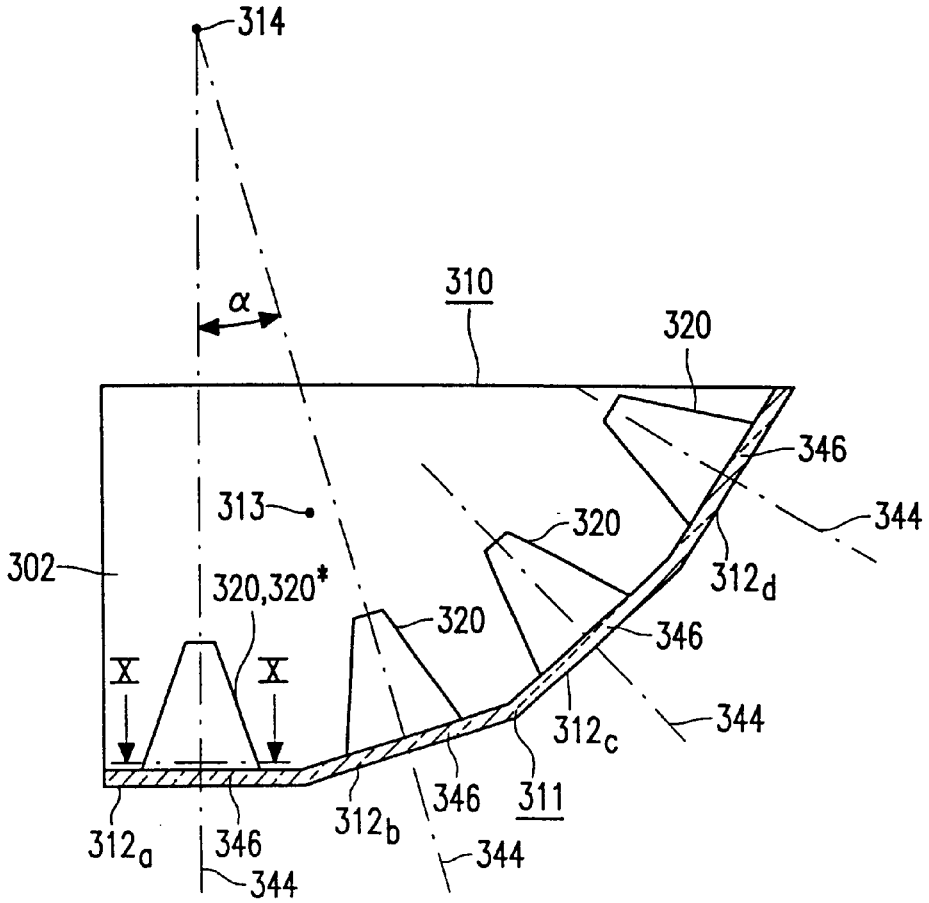
FIG. 9 is a cross-section taken on the line IX—IX in FIG. 8.

A second embodiment of the lighting module according to the invention is shown in FIGS. 6 and 7. Components in these Figures corresponding to those in FIGS. 1 to 3 have reference numerals which are 200 higher. The luminaire 201 in this embodiment comprises a single lighting module 202 with 25 lighting units 220. The 25 lighting units lie in one plane in a regular arrangement and have mutually parallel optical axes 244. In the embodiment shown, components 247, here formed by reliefs, of optical systems 240 of individual lighting units 220 have been integrated into a transparent plate 246 provided in the light emission window 211. The reliefs 247 split up the beams generated by the LED chips into two beams diverging from one another. In a modification, the light beams generated by the LED chips are split up into more, for example four beams. In another modification, the beams generated by the LED chips are not split up but, for example, deflected or widened. The luminaire shown is suitable, for example, for spotlighting.

Figure 10A:
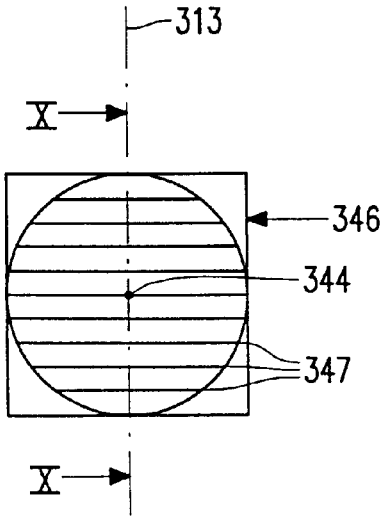
FIG. 10A is a cross-section taken on the line X—X in FIG. 9.
Figure 10B:
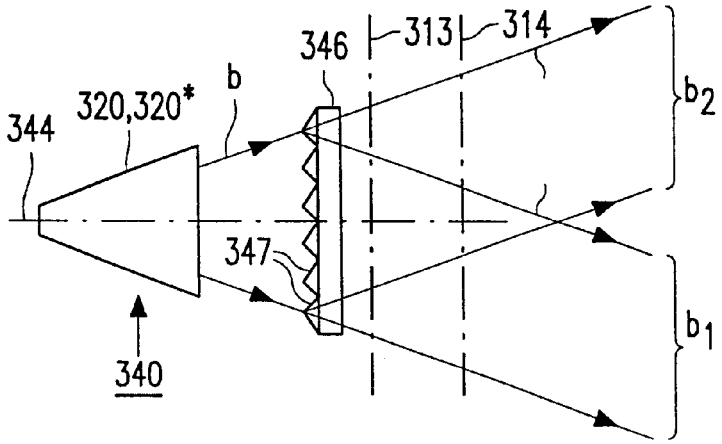
FIG. 10B is a cross-section taken on the line X—X in FIG. 10A.

A third embodiment of the luminaire 301 designed for street lighting is shown in FIGS. 8, 9, 10A and 10B. Components therein corresponding to those in FIGS. 1 to 3 have reference numerals which are 300 higher. In the embodiment shown, 40 lighting units 320 are arranged in four rows $312_a$, $312_b$, $312_c$, $312_d$ of ten units each extending along a longitudinal axis 313 parallel to the street to be illuminated. In the embodiment shown, lighting units in one row are arranged at equal mutual interspacings parallel to the longitudinal axis. Alternatively, however, lighting units in a row may be arranged, for example, in a zigzag pattern along the longitudinal axis. Lighting units 320 in one and the same row have optical axes 344 which are directed mutually substantially parallel and which are transverse to the longitudinal axis 313. Optical axes 344 of lighting units 320 of different rows $312_a$, $312_b$ enclose an angle $\alpha$ with one another around a further axis 314 parallel to the longitudinal axis 313 (see FIG. 9). In this case the angles enclosed by the optical axes of the lighting units of two consecutive rows are equal to $\alpha$ each time. This, however, is not necessarily the case. As in the second embodiment, components 347, i.e. reliefs, of the optical systems 340 of different lighting units have been integrated into a transparent plate 346 which is mounted in the light emission window 311. FIGS. 10A and 10B show that the relief 347 is formed by ridges of triangular cross-section which extend in a direction transverse to the longitudinal axis 313. The ridges are substantially mirror-symmetrical. The reliefs 346 form deflected beams b1 from the beams b generated by the LED chips 320, said deflected beams lying substantially symmetrically relative to a plane through the optical axis 344 of the relevant lighting unit and through the further axis 314. The reliefs 347 here split up the beams b into a first beam b1 and a second beam b2. The beams b1, b2 lie on either side of the optical axis 344. This is shown for only one of the lighting units 320* for the sake of clarity. The light emission window has a first and a second further transparent plate 346', 346" which extend transversely to the longitudinal axis and behind which further lighting units 320', 320" are positioned.

Figure 11:
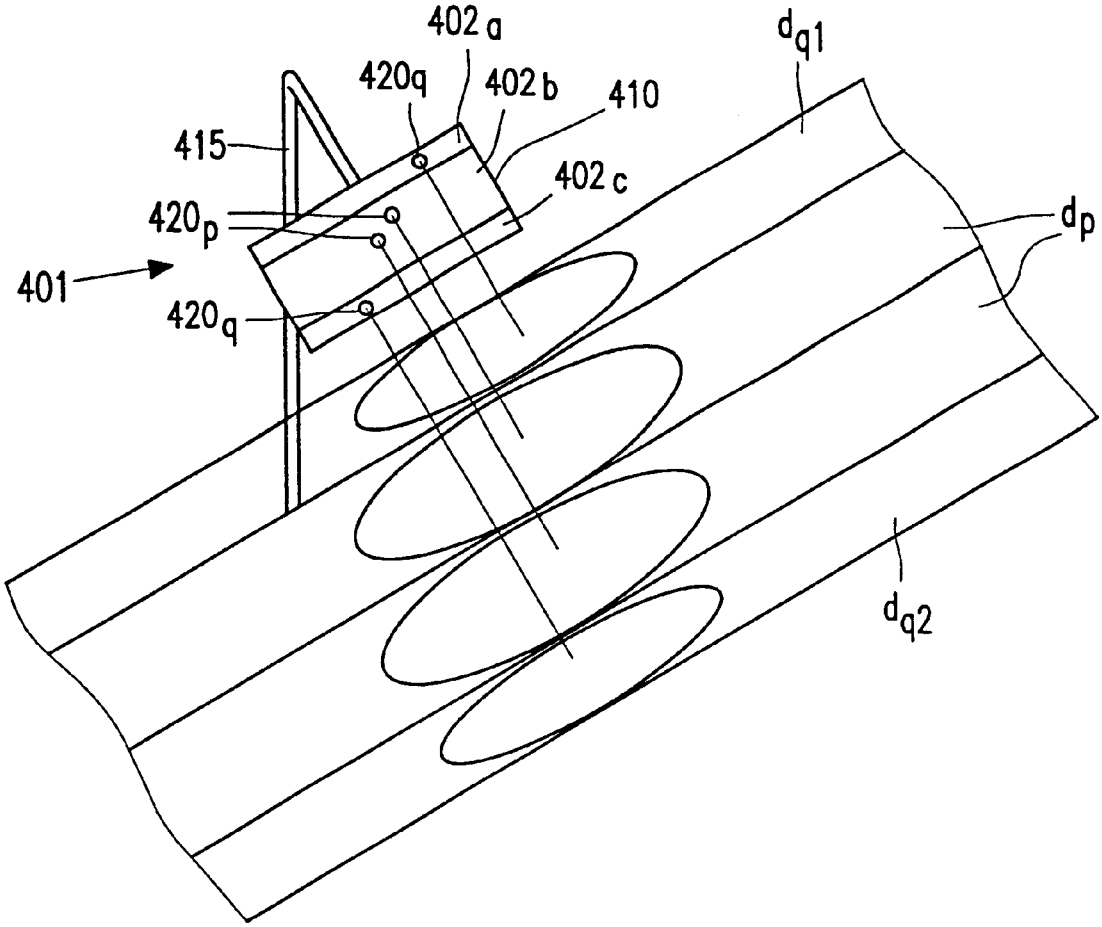
FIG. 11 shows a fourth embodiment.

A fourth embodiment is shown in FIG. 11. Components therein corresponding to components of FIGS. 1A, 1B, 2, and 3 have reference numerals which are 400 higher.

In the luminaire 401 shown, the set of lighting units 420 comprise two or more varieties of lighting units 420*p*, 420*q* for illuminating portions of the object with mutually differing spectra.

The set of lighting units here comprises a first variety of lighting units 420*p* for illuminating central portions of the object, driving lanes of a road in this case, with a spectrum having a maximum in a wavelength range from 550 to 610 nm, i.e. at a first wavelength of 592 nm. The lighting units of the first variety are for this purpose equipped with LED chips with an active layer of AlInGaP. The set of lighting units 420 comprises a second variety of lighting units 420*q* equipped with LED chips with an active layer of InGaN for illuminating peripheral portions of the object with a spectrum having a maximum in a wavelength range from 500 to 530 nm, i.e. at a second wavelength of 510 nm, shorter than the first wavelength. The lighting units 420*p* of the first variety constitute a lighting module 402*b*. Lighting modules 402*a* and 402*c* comprise lighting units 420*q* of the second variety. The peripheral portions dq1, dq2 of the object may be provided with vegetation. The comparatively high reflectivity thereof in the wavelength range from 500 to 530 nm contributes further to the visibility of any objects present in these locations.

Figure 12:
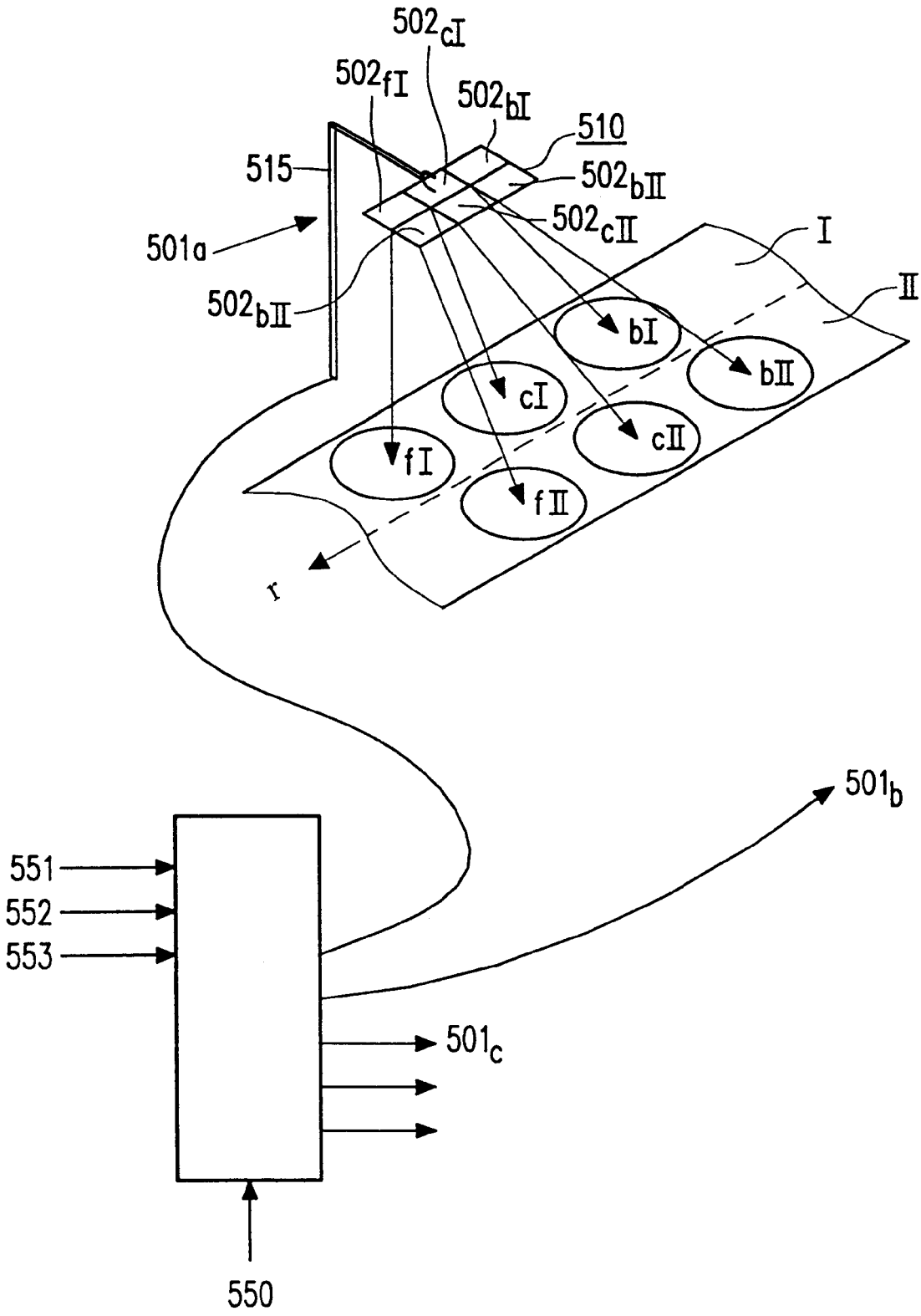
FIG. 12 shows a lighting system according to the invention.

In FIG. 12, components corresponding to those of FIGS. 1A, 1B, 2, and 3 have reference numerals which are 500 higher. FIG. 12 diagrammatically shows a lighting system according to the invention with a luminaire $501_a$ and a control system 550. The luminaire $501_a$ forms part of a group of identical luminaires $501_a$, $501_b$, . . . according to the invention which are arranged at equal mutual interspacings on posts 515 along a street to be illuminated. The luminaire 501*a* comprises six lighting modules $502_{fI}$, $502_{fII}$, $502_{cI}$, $502_{cII}$, $502_{bI}$, and $502_{bII}$, each fitted with 24 lighting units. Lighting modules $502_{fI}$, and $502_{fII}$ are designed for illuminating road sections $f_I$, $f_{II}$ removed from the post 515 in a direction opposed to the driving direction r. Lighting modules $502_{bI}$ and $502_{bII}$ are designed for illuminating road sections $b_I$, $b_{II}$ lying removed from the post 515 in the driving direction r. Lighting modules $502_{cI}$ and $502_{cII}$ are designed for illuminating a road section $c_I$, $c_{II}$ lying between the other two. Lighting modules $502_{fII}$, $502_{cII}$, and $502_{bII}$, illuminate a first driving lane I, and lighting modules $502_{fII}$, $502_{cII}$ and $502_{bII}$, illuminate a second driving lane II. The lighting modules are connected to a control system 550 and are controllable independently of one another by means of this control system. The control system receives signals 551 from a sensor for measuring the degree of wetness of the road surface, signals 552 from a sensor for detecting fog and possibly for ascertining the degree of light scattering caused thereby. The lighting system is activated by a central signal 553. In the activated state, the lighting modules may be adjusted by the control system, for example, as follows.

| Weather conditions | Lighting system setting |
|---|---|
| — | on: $502_{fI}$, $502_{fII}$, $502_{cI}$, $502_{cII}$, $502_{bI}$, $502_{bII}$ |
| rain | on: $502_{fII}$, $502_{cI}$, $502_{cII}$, $502_{bI}$, $502_{bII}$<br>off: $502_{fI}$ |
| snow | dimmed: $502_{fI}$, $502_{fII}$, $502_{cI}$, $502_{cII}$, $502_{bI}$, $502_{bII}$ |
| fog | on: $502_{cI}$, $502_{cII}$;<br>dimmed: $502_{fI}$, $502_{fII}$, $502_{bI}$, $502_{bII}$ |

If water is present on the road surface, lighting module $\mathbf{502}_{fI}$ is dimmed or switched off entirely, so that disturbing reflections on the water surface are avoided. All lighting modules are dimmed in the case of a snow-covered road surface. A low illuminance is sufficient in that case for a good visibility. A normal light intensity may lead to glare under these circumstances. The best possible visibility is found to be obtained in the case of fog by means of a setting in which light originates mainly from the lighting modules $\mathbf{502}_{cI}$, $\mathbf{502}_{cII}$. The setting of the lighting modules may in addition depend on the traffic density. It is possible to save energy at a low traffic density in that the lighting system is used as a guiding lighting. This is realized, for example, in that only one out of every six lighting modules in each luminaire is operating. An even greater energy saving is possible in a control mode of the control system where modules are switched on temporarily when they are about to be passed by a vehicle.

What is claimed is:

1. A luminaire (1) comprising a housing (10) with a light emission window (11), at least one lighting module in said housing (2) for illuminating an object (d, d1, d2, d3) outside said housing, the lighting module comprising a set of lighting units (20), each lighting unit comprising at least one LED chip (30) and an optical system (40) cooperating therewith, the lighting units illuminating portions of the object (d, d1, d2, d3) during operation, each said LED chip supplying a luminous flux of at least 5 lm during operation.

2. A luminaire as claimed in claim 1, wherein the set of lighting units (20) comprises at least two types (20*a*, 20*b*, 20*c*) of lighting units for generating beams which widen more and less strongly.

3. A luminaire as claimed in claim 1 wherein the optical system (40) of the lighting units (20) comprises a primary (41, 42) and a secondary optical system (43), said primary optical system being provided with a primary reflector (41) on which the LED chip (30) is provided and with a transparent envelope (42) in which the LED chip (30) is embedded, said secondary optical system (43) being provided with a secondary reflector (43) in whose comparatively narrow end portion ($\mathbf{43}_a$) the LED chip is positioned.

4. A luminaire as claimed in claim 3, characterized in that the secondary reflector (43) supports a lens (45) at an end ($\mathbf{43}_c$) opposite the comparatively narrow end portion ($\mathbf{43}_a$).

5. A luminaire as claimed in claim 1 wherein the optical system (140) of the lighting unit (120) comprises a transparent body (149) with a first optical part ($\mathbf{149}_d$) which deflects the light generated by the LED chip (130) through refraction and a second optical part ($\mathbf{149}_c$) which deflects the light generated by the LED chip through reflection.

6. A luminaire as claimed in claim 5, characterized in that the transparent body (149) has a wide end ($\mathbf{149}_c$) and opposite thereto a comparatively narrow end portion ($\mathbf{149}_f$), in which end portion the LED chip (130) is embedded, while the side of the LED chip remote from the wide end of the transparent body is provided on a primary reflector (141), said transparent body having a spherical portion ($\mathbf{149}_d$) which is centrally positioned relative to an axis (144), which is recessed into the wide end ($\mathbf{149}_c$), and which forms the first optical part, while the body has a peripheral portion ($\mathbf{149}_c$) around the axis (144) with a paraboloidal circumferential surface ($\mathbf{149}_b$) around the axis which forms the second optical part.

7. A luminaire as claimed in claim 1 wherein components (247; 347) of the optical systems (240; 340) of different lighting units (220; 320) are mutually integrated.

8. A luminaire as claimed in claim 7, characterized in that lighting units (320) are arranged in rows ($\mathbf{312}_a$, $\mathbf{312}_b$, $\mathbf{312}_c$, $\mathbf{312}_d$) which extend along a longitudinal axis (313), lighting units in one and the same row ($\mathbf{312}_a$) having optical axes (344) which are directed substantially mutually parallel and transverse to the longitudinal axis, while optical axes (344) of lighting units of different rows ($\mathbf{312}_a$, $\mathbf{312}_b$) enclose an angle ($\alpha$) with one another each time around a further axis (314) parallel to the longitudinal axis, and the integrated components (347) of the optical systems (340) form deflected beams ($b_1$), which are substantially symmetrically situated relative to a plane through the optical axis of the lighting unit and the further axis, from the beams (b) formed by the lighting units.

9. A luminaire as claimed in claim 7 wherein the integrated components (247; 347) of the optical systems (240; 340) are reliefs in a transparent plate (246; 346) in the light emission window (211; 311).

10. A luminaire as claimed in claim 9, characterized in that the relief (347) is formed by ridges.

11. A luminaire as claimed in claim 1 wherein the set of lighting units (420) comprises two or more varieties of lighting units (420*p*, 420*q*) for illuminating portions (dp, dq1, dq2) of the object with mutually differing spectra.

12. A luminaire as claimed in claim 11, characterized in that the set of lighting units (420) comprises a first variety of lighting units (420*p*) for illuminating central portions (dp) of the object with a spectrum having a maximum at a first wavelength, and a second variety of lighting units (420*q*) for illuminating peripheral portions (dq1, dq2) of the object with a spectrum having a maximum at a second wavelength which is smaller than the first wavelength.

13. A luminaire as claimed in claim 12, characterized in that the first wavelength lies in a range from 550 to 610 nm and the second wavelength in a range from 500 to 530 nm.

14. A lighting system comprising at least one luminaire comprising a housing with a light emission window and a lighting module in said housing for illuminating an object outside of said housing said module comprising a plurality of lighting units each comprising at least one LED chip and an optical system, said LED chips each supplying a luminous flux of at least 5 lm during operation, said luminous flux being directed through a respective optical system toward respective portion of said object.

15. A lighting system as in claim 14 wherein each said luminaire comprises a plurality of said lighting modules in said housing, said lighting system further comprising means for controlling said lighting modules independently of each other.

* * * * *

UNITED STATES PATENT AND TRADEMARK OFFICE

CERTIFICATE OF CORRECTION

PATENT NO. : 6,250,774 B1 
DATED : June 26, 2001
INVENTOR(S) : Simon H.A. Begemann et al.

It is certified that error appears in the above-identified patent and that said Letters Patent is hereby corrected as shown below:

Column 9,
Line 30, delete "(1)" and "(10)";
Line 31, delete "(11)";
Line 32, delete "(2)" and "(d, d1, d2, d3)";
Line 34, delete "(20)";
Line 34, after "each" insert -- of said --;
Line 34, change "unit" to -- units --;
Line 35, delete "(30)" and "(40) cooperating";
Line 36, change "therewith, the lighting units illuminating" to -- configured to illuminate --;
Line 37, delete "(d, d1, d2, d3)";
Line 40, delete "(20)" and "(20a, 20b,";
Line 41, delete "20c)";
Line 44, delete "(40)" and "(20)";
Line 45, delete "(41, 42)" and "(43)";
Line 46, delete "(41)";
Line 47, delete "(30)";
Line 48, delete "(42)" and "(30)";
Line 49, delete "(43)";
Line 50, delete "(43)";
Line 51, delete "(43a)";
Line 52, delete "characterized in that";
Line 53, before "the" insert -- wherein --;
Line 53, delete "(43)" and "(45)";
Line 54, delete "(43a)" and "(43a)";
Line 56, delete "(140)" and "(120)";
Line 57, delete "(149)" and "(149a)";
Line 58, delete "(130)";
Line 59, delete "(149c)".

UNITED STATES PATENT AND TRADEMARK OFFICE

CERTIFICATE OF CORRECTION

PATENT NO. : 6,250,774 B1
DATED : June 26, 2001
INVENTOR(S) : Simon H.A. Begemann et al.

It is certified that error appears in the above-identified patent and that said Letters Patent is hereby corrected as shown below:

Column 10,
Line 1, delete "(130)" and "while";
Line 2, change "the" to -- and wherein a primary reflector is located on a --;
Line 3, delete "is provided on a primary reflector (141)";
Line 4, delete "(149d)";
Line 5, delete "(144)";
Line 6, delete "(149c)";
Line 8, delete "(149c)" and "(144)";
Line 9, delete "(149b)";
Line 12, delete "(247; 347)" and "(240; 340)";
Line 13, delete "(220; 320)";
Line 13, after "integrated" insert -- to illuminate said portions of the object --;
Line 14, change "characterized in that" to -- wherein the different --;
Line 15, delete "(320)" and "(312a, 312b, 312c)";
Line 16, delete "312d)" delete "(313)";
Line 17, delete "(312a)";
Line 18, delete "(344)";
Line 19, delete "(344)";
Line 21, delete "(α)";
Line 22, delete "(314)";
Line 23, delete "(347)" and "(340)";
Line 24, delete "($b_1$)";
Line 26, delete "(b)";
Line 29, delete "(247; 347)" and "(240;";
Line 30, delete "340)" and "(246; 346)";
Line 31, delete "(211; 311)";
Line 32, delete "characterized in";
Line 33, change "that" to -- wherein one of --;
Line 33, delete "(347)";
Line 35, delete "(420)";
Line 36, delete "(420p, 420q)" and "(dp,";
Line 37, delete "dq1, dq2)";
Line 37, change "mutually differing" to -- different --;

UNITED STATES PATENT AND TRADEMARK OFFICE

CERTIFICATE OF CORRECTION

PATENT NO. : 6,250,774 B1 
DATED : June 26, 2001
INVENTOR(S) : Simon H.A. Begemann et al.

It is certified that error appears in the above-identified patent and that said Letters Patent is hereby corrected as shown below:

Column 10, cont'd.
Line 38, delete "characterized in";
Line 39, change "that" to -- wherein --;
Line 39, delete "(420)";
Line 40, delete "(420p)" and "(dp)"
Liine 42, delete "(420q)";
Line 43, delete "(dq1, dq2)";
Line 46, delete "characterized in";
Line 47, change "that" to -- wherein --;
Line 53, after "each" insert -- of said plurality of lighting units --;
Line 58, after "each" insert -- at least one --.

Signed and Sealed this

Seventh Day of January, 2003

JAMES E. ROGAN
*Director of the United States Patent and Trademark Office*